US011179010B2

(12) United States Patent
Sexton et al.

(10) Patent No.: US 11,179,010 B2
(45) Date of Patent: Nov. 23, 2021

(54) PAPER PRODUCT DISPENSER

(71) Applicant: Kimberly-Clark Worldwide, Inc., Neenah, WI (US)

(72) Inventors: Joseph M. Sexton, Roswell, GA (US); Eric M. Chalko, Alpharetta, GA (US); Klemen Erzen, Preddvor (SI)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/474,025

(22) PCT Filed: Dec. 30, 2017

(86) PCT No.: PCT/US2017/069145
§ 371 (c)(1),
(2) Date: Jun. 26, 2019

(87) PCT Pub. No.: WO2018/126236
PCT Pub. Date: Jul. 5, 2018

(65) Prior Publication Data

US 2019/0380546 A1 Dec. 19, 2019

Related U.S. Application Data

(60) Provisional application No. 62/440,913, filed on Dec. 30, 2016.

(51) Int. Cl.
*A47K 10/36* (2006.01)
*A47K 10/38* (2006.01)

(52) U.S. Cl.
CPC ..... *A47K 10/3618* (2013.01); *A47K 10/3612* (2013.01); *A47K 10/3687* (2013.01); *A47K 2010/3854* (2013.01)

(58) Field of Classification Search
CPC ..... A47K 10/3618; A47K 10/3612; A47K 10/3687; A47K 10/3854
See application file for complete search history.

(56) References Cited

U.S. PATENT DOCUMENTS

| | | | | |
|---|---|---|---|---|
| 4,635,837 | A * | 1/1987 | Granger | A47K 10/3643 225/96 |
| 5,131,302 | A * | 7/1992 | Watanabe | A47K 10/3656 83/167 |
| 5,857,393 | A | 1/1999 | Kohiyama | |
| 5,908,137 | A * | 6/1999 | Pattarozzi | A47K 10/3643 221/45 |
| 8,424,431 | B1 | 4/2013 | Jackman et al. | |
| 10,136,769 | B2 * | 11/2018 | Osborne, Jr. | A47K 10/38 |
| 2002/0109034 | A1 | 8/2002 | Moody et al. | |
| 2008/0245922 | A1 | 10/2008 | Fellhoelter | |
| 2016/0227970 | A1 * | 8/2016 | Diamond | B65H 35/0086 |

(Continued)

FOREIGN PATENT DOCUMENTS

| | | | |
|---|---|---|---|
| CN | 201727440 | U | 2/2011 |
| EP | 2601873 | A1 | 6/2013 |

(Continued)

*Primary Examiner* — Omar Flores Sanchez

(57) ABSTRACT

Systems and apparatus for dispensing of paper products. The dispenser includes two spindle arms. A rolled paper product rests on top of the two spindle arms and during dispensing the roll rotates on top the two spindle arms.

6 Claims, 4 Drawing Sheets

(56) References Cited

U.S. PATENT DOCUMENTS

| | | | | |
|---|---|---|---|---|
| 2016/0353945 | A1* | 12/2016 | Osborne, Jr. | B65H 20/02 |
| 2016/0353947 | A1* | 12/2016 | Osborne, Jr. | B65H 16/106 |
| 2017/0055787 | A1* | 3/2017 | Borke | A47K 10/424 |
| 2018/0064297 | A1* | 3/2018 | Goeking | A47K 10/3625 |
| 2020/0054178 | A1* | 2/2020 | Duarte | A47K 10/36 |
| 2020/0163498 | A1* | 5/2020 | Osborne, Jr. | A47K 10/3687 |

FOREIGN PATENT DOCUMENTS

| | | | |
|---|---|---|---|
| JP | 2012000225 | A | 1/2012 |
| JP | 5261759 | B2 | 8/2013 |
| WO | 08129572 | A1 | 10/2008 |

* cited by examiner

PAPER PRODUCT DISPENSER

This application claims priority from U.S. provisional Patent Application Ser. No. 62/440,913 filed on Dec. 30, 2016, the entire contents of which are incorporated herein by reference.

This disclosure generally relates to a consumable product dispensing system.

BACKGROUND

Systems dispensing consumable products are ubiquitous in many environments today. For example, consumable product, e.g., hand towel, dispensers are commonplace in many private, semi-private and public washrooms, break rooms, kitchens and work spaces. Given this widespread adoption, it's desirable to ensure the consumable products correctly and consistently dispense, and the dispensers are reliable and easy to service.

SUMMARY

In general, the subject matter of this specification relates to a paper product dispenser for rolled paper products. One aspect of the subject matter described in this specification can be implemented in systems that include a housing comprising a front, a back, two sides, and a product holding area defined by the front, back and two sides; a first spindle arm in the product holding area and extending between the two sides, a second spindle arm in the product holding area, extending between the two sides and substantially parallel to the first spindle arm, wherein the first and second spindle arms are configured to hold a rolled paper product along a periphery of the rolled paper product and (optionally) rotate to allow the rolled paper product to be unwound; and a cutting drum configured to cut unwound portions of the rolled paper product. Other embodiments of this aspect include corresponding apparatus and methods.

Yet another aspect of the subject matter described in this specification can be implemented in a method including in response to a user action, driving at least one of a first spindle arm and second spindle arm, wherein the first and second spindle arms are substantially parallel and are configured to hold a rolled paper product along a periphery of the rolled paper product; unwinding the rolled paper product in response to driving the at least one of a first spindle arm and second spindle arm; and cutting the unwound rolled paper product with a cutting drum, wherein the cutting drum rotates more than once before the cutting. Other embodiments of this aspect include corresponding apparatus and systems.

In some implementations, the systems, apparatuses and methods described herein have one or a combination of the following features. The first and second spindles lie in a same horizontal plane. A rotation of the cutting drum and rotation of at least one of the first and second spindles are driven by a drive belt. The cutting drum rotates more than once before cutting the rolled paper product, for example, the cutting drum rotates twice and then cuts the rolled paper product.

The dispenser can include a stub roll holder below the first and second spindles, wherein the first and second spindles are separated by a first distance and when a diameter of the paper product roll is less than the first distance, for example, 60 or 90 millimeters, the paper product roll drops into the stub roll holder. After the paper product drops into the stub roll holder paper from the paper product travels over the first spindle arm in a counterclockwise direction during dispensing. The dispenser can include a paper feed device configured to rotate the first (or second) spindle arm in a clockwise direction in response to a user action. The user action can be a manual actuation of the dispensing process through force applied to an actuation device of the dispenser, e.g., a user pull on the exposed portion of the roll, or the dispenser can include a motor to rotate at least one of the first and second spindles. The user action can be a non-touch action causing the motor to actuate.

Particular embodiments of the subject matter described in this specification can be implemented so as to realize one or more of the following advantages. Loading of a paper product roll is easier as the roll merely needs to be placed on top of the spindle arms. The dispenser auto-feeds the roll sheet into the dispensing mechanism (e.g., for cutting by the cutting drum) such that the user does not have to wind the roll sheet through multiple feed points and/or rollers. The dispenser can accept paper product rolls with cores and without cores, with tubes and without tubes, and accept rolls with various core and tube sizes and shapes without modification, as the roll rests on the spindle arms and is not supported by or through its core or tube.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
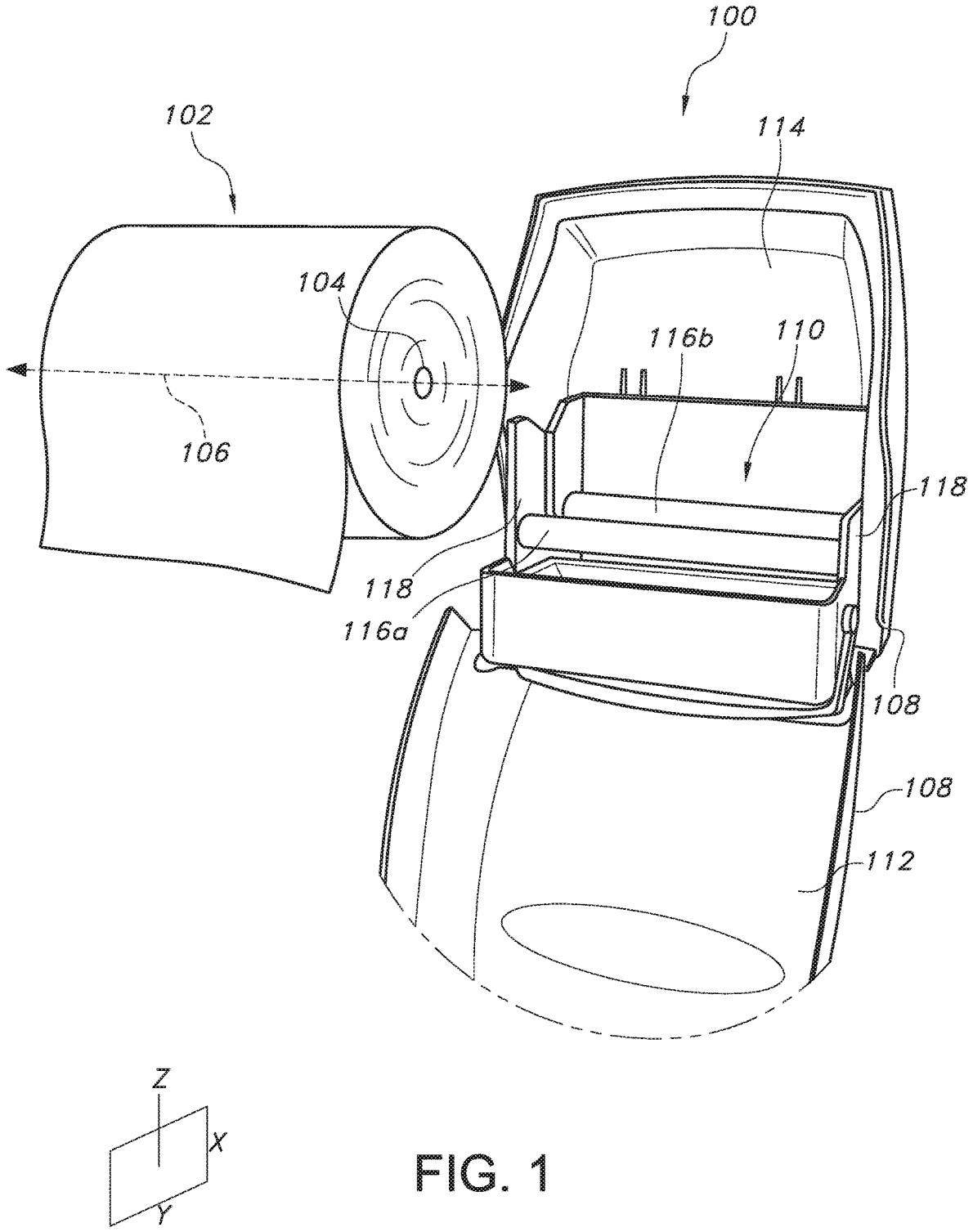
FIG. 1 is a representation of an example paper product dispenser.

The present disclosure generally relates to a rolled paper product dispenser that includes multiple spindles on top of which paper product rests and can rotate to unwind for dispensing.

In some implementations, the dispenser includes two spindle arms (or rotating arms or spindles) in spaced relation in a horizontal plane. The rolled paper product sits on top of and is supported by the two spindles. The spindles rotate to allow the paper product to rotate and unwind for dispensing. This permits the paper product roll to be supported and unwound without requiring a spindle through its core or other support arms engaged to the roll's core or its center axis, e.g., as would be the case for coreless rolls. Thus rolled paper products can easily be loaded into the dispenser without requiring the sometimes difficult or cumbersome process of such core or center axis support. Further, as the core, configuration and/or form factor of rolled paper products can vary, and the core or center supports must be matched to these various configurations and form factors to properly support the roll, this dispenser offers a universal-type platform for accepting differing rolls without requiring changes to a core or center axis support system. The dispenser is described in more detail below with reference to FIG. 1, which is a representation of an example product dispenser 100 and FIG. 2, which is a representation of an example product dispenser 100 with paper product 102.

The dispenser 100 can be, for example, a hand towel dispenser 100, or the like, e.g., bath tissue or wipers/wipers, for rolled paper products 102. A paper product describes sheet materials made from cellulose fibers (e.g., wood pulp), synthetic fibers (e.g., polypropylene) or some combination thereof, and include, for example, bath tissue, paper towels and wipes/wipers. A rolled product is a product that is wound around a core 104 or center axis 106, e.g., the axis around which the paper product 102 is wound.

The dispenser 100 includes a body 108, e.g., a composite or metal housing, with an outer surface, e.g., an exterior surface of the body 108. The dispenser 100 also includes a product holding area 110 to hold the paper product 102. As shown in FIG. 1, the dispenser 100 is illustrated with the front cover 112 of the body 108 opened to show the product holding area 110.

Figure 2:
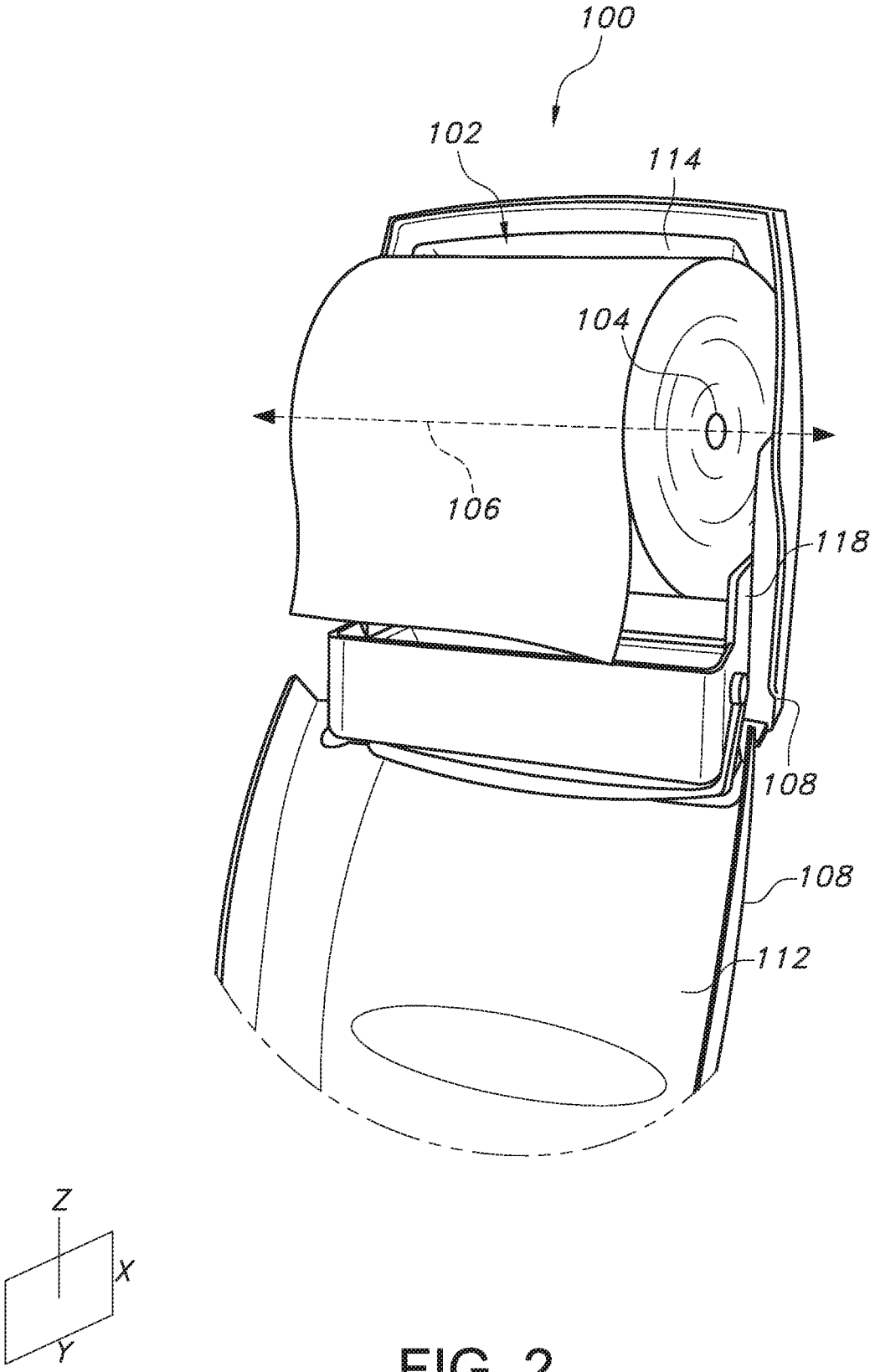
FIG. 2 is a representation of an example paper product dispenser with paper product.

In some implementations, the product holding area 110 is a space or cavity within the body 108 in which the product 102 can be positioned for dispensing, and can be accessed by rotating the front cover 112 away from the back cover 114 (e.g., the wall mounted portion) by a hinge or the like. The dispenser 100 also includes a first spindle arm 116*a* (e.g., close to the front cover 112 when closed) and a second spindle arm 116*b* (e.g., close to the back cover 114) in the product holding area 110. In combination, the first and second spindles 116 are used to hold the paper product roll 102 along its periphery, as shown in FIG. 2, and rotate to facilitate unwinding the roll 102 for dispensing to a user. The spindle arms 116 are positioned between the sides 118 e.g., on arms proximate or attached to the sides 118, and each arm 116, in some implementations, includes a roller or other rotation member that rotates along with (or drives) the unwinding of the roll 102. In some implementations, the spindle arms 116 do not rotate. In this case, for example, the rolled product 102 can rotate in place (held and supported by the spindle arms 116) in response to a user pull on an exposed portion of the product 102.

The spaced relation of the spindle arms 116, in some implementations, is substantially parallel to each other in the horizontal plane XY, e.g., both are in or near the XY plane. But, more generally, as used herein, spaced relation means that the two spindle arms 116 are positioned relative to each other to allow a roll 102 to rest on them and not fall off from gravity, and placed no further apart than the diameter of the roll 102. In some implementations, other support devices can additionally be used to support and/or hold the roll 102.

Figure 3A:
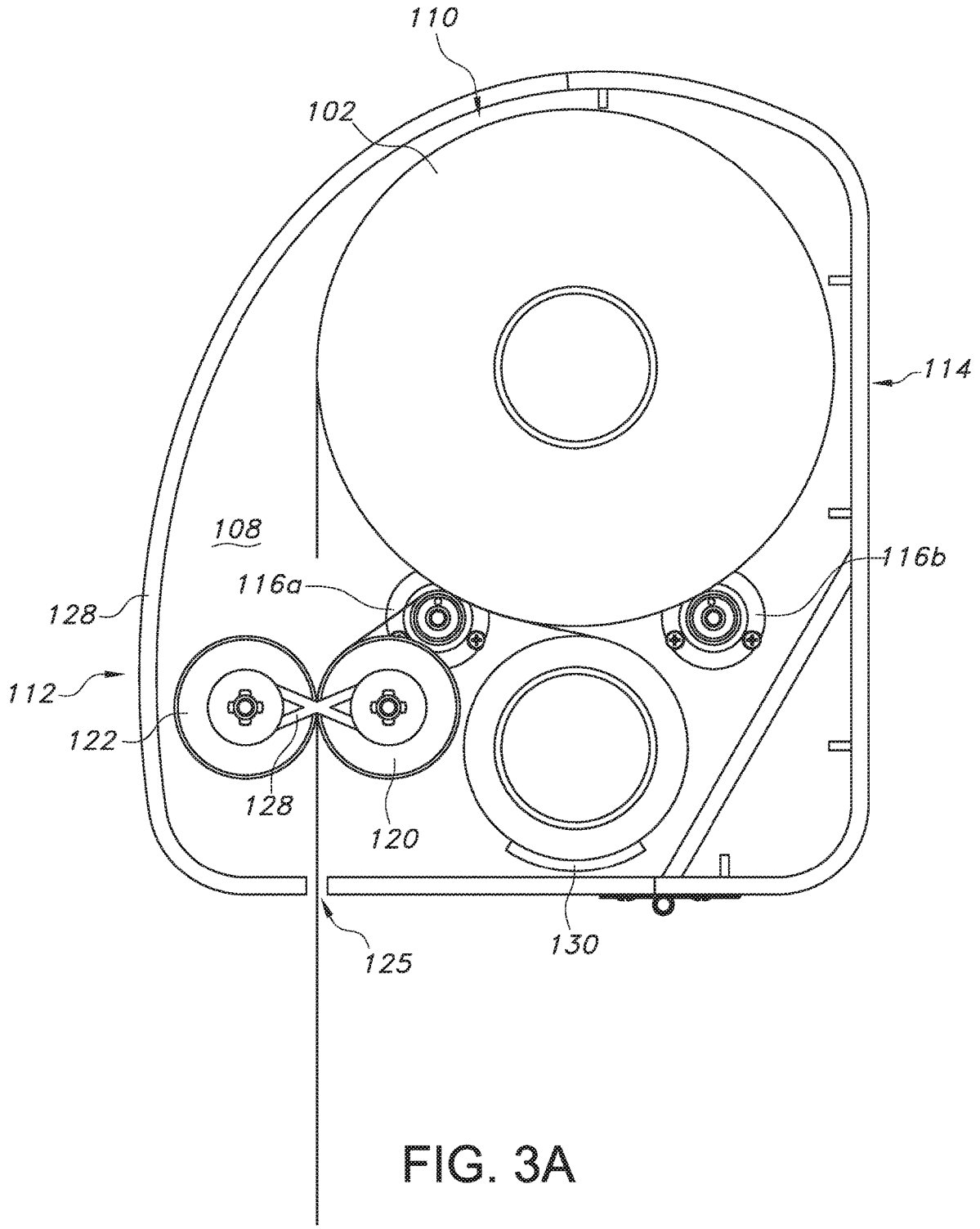
FIG. 3A is a side view of a representation of a cutaway of an example dispenser.

The dispenser 100 includes a cutting drum 120. The cutting drum 120 cuts unwound portions of the rolled paper product 102 and is shown in FIG. 3A, which is a side view of a representation of a cutaway of an example dispenser 100, and FIG. 3B, which is a perspective view of a representation of a cutaway of an example dispenser 100. In some implementations, the cutting drum 120 rotates about the y-axis and includes a spring-loaded knife that cuts the unwound portion of the paper product 102 that is feed between the cutting drum 120 and the dispenser feeding roller 122 (e.g., which also rotates around the y-axis, similar to line 106, and serves to feed paper from the paper product roll 102 out of the dispenser 100 for dispensing to a user). For example, in response to the cutting drum 120 turning a specified number of revolutions (e.g., one revolution or more than one revolution), the cutting drum knife will spring forward and cut the paper product 102 at a point proximate to the drum 120.

In some implementations, the cutting drum 120 may be replaced by a roller guide, similar to roller 122 and there is a cutting mechanism below the roller 122 and roller guide that cuts the paper at a specified point (e.g., after a certain length of paper is unwound from the roll 102 or after a predetermined number of rotations of the spindles 116 or roller 122 and/or roller guide). In some implementations, the cutting drum 120 (or roller guide) and roller 122 are positioned such that gravity guides the unwound paper from the roll 102 to feed between the cutting drum 120 (or roller guide 123) and roller 122.

In some implementations, the dispenser 100 includes a drive belt (not pictured) that is coupled to one or both spindle arms 116 and, in some implementations, the cutting drum 120 (and, optionally the roller 122). In some implementations in which the roller 122 is not directly coupled to the drive belt, the cutting drum 120 and roller 122 are coupled together through a belt assembly 128 such that rotation of the cutting drum 120 (which is attached to the drive belt) causes the roller 122 to rotate. In some implementations, the drive belt is also coupled to and driven by (or moves in response to) a paper feed device, e.g., a push bar or rotating knob or an electric motor. For example, the dispenser 100 includes a proximity sensor (e.g., IR sensor) that detects a user movement indicative of requesting a dispense. Upon such detection, for example, the motor actuates and drives the drive belt, which, in turn, rotates the one or both spindles 116 and the cutting drum 120.

In some implementations, the rotations of the roll 102, cutting drum 120 and spindle(s) 116 are caused by a user pulling a portion of the paper product 102 exposed at the dispenser opening 125. If the roll 102 has not been unwound to expose any paper at the opening 125, a user can use the paper feed device to advance the roll 102 to cause an unwound portion of the roll 102 to be exposed at the opening 125.

Figure 3B:
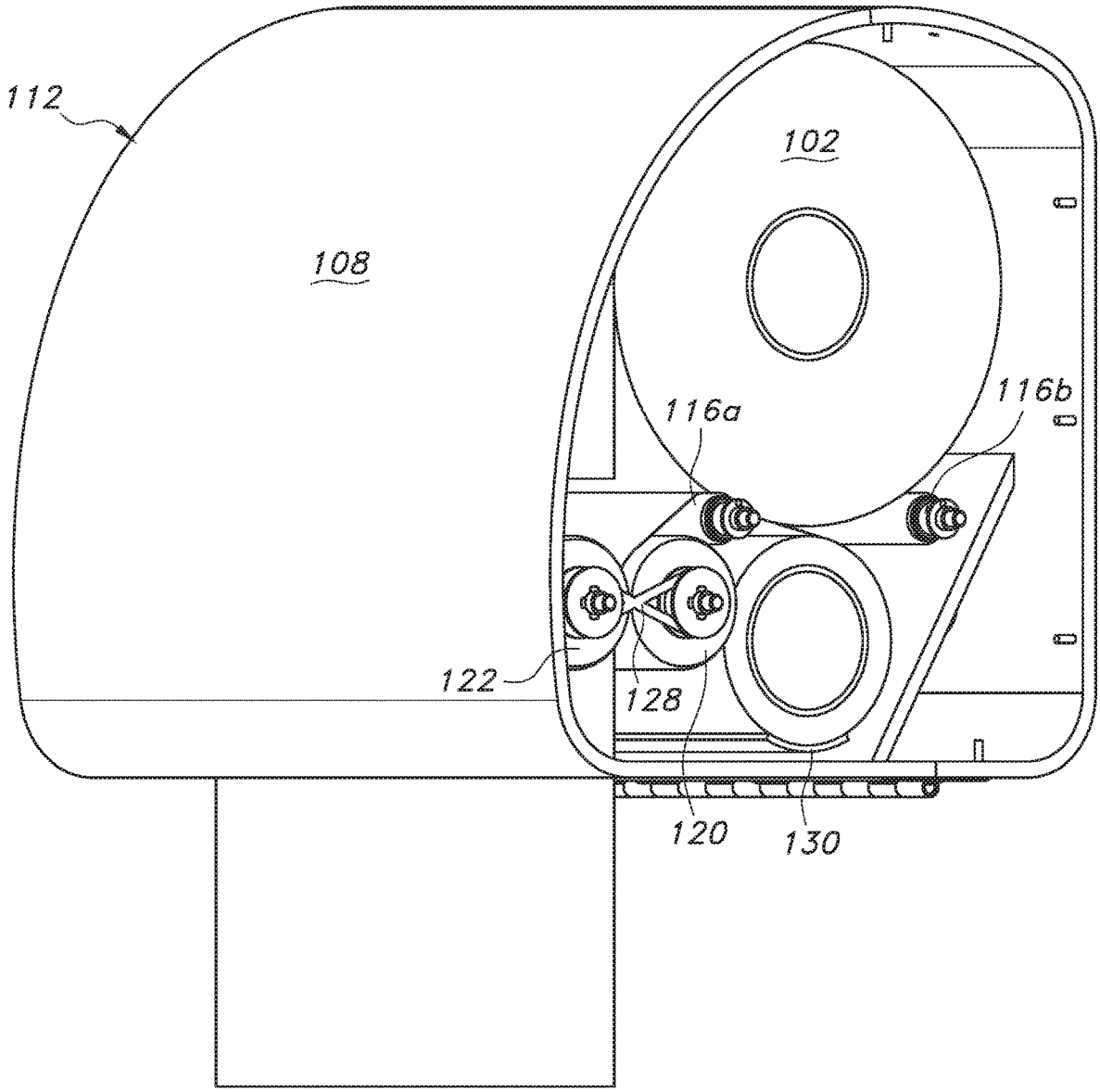
FIG. 3B is a perspective view of a representation of a cutaway of an example dispenser.

In FIGS. 3A and 3B, first spindle arm 116*a* rotates in a clockwise direction to cause the roll 102 to unwind in a counterclockwise direction. In some implementations, the cutting drum 120 is coupled to the drive belt such that when the drive belt rotates the first spindle 116*a* in a clockwise direction it also rotates the cutting drum 120 in a counterclockwise direction, which pulls the unwound portion of the paper product 102 from the roll and feeds it down to the dispenser opening 125 for use by a user.

In some implementations, the dispenser 100 includes a stub roll holder 130 below the first and second spindle arms 116. The stub roll holder 130 holds the rolled paper product 102 after the rolled paper product 102 is used (depleted) to the point that the diameter of the roll 102 is less than the distance between the spindle arms 116 (the first distance), at which point the spindle arms 116 can no longer support the roll 102 and it drops down (e.g., by gravity and, optionally, through a guide or channel) into the stub roll holder 130. For example, in some implementations, the first distance is between 60 and 90 millimeters, but it can be greater or less as a design choice. In some implementations, the stub roll holder 130 is a curved platform on which the roll 102 is supported after it drops down between the spindle arms 116—the curve assists the roll 102 to stay in place while is it being pulled to unwind.

When the roll 102 is in the stub roll holder 130, the unwound portion of the sheet remains on top of the spindle arm 116*a*, and, for example, as a user pulls on the exposed part of the unwound roll 102 the spindle arm 116*a* rotates in a counterclockwise direction. When the roll 102 is in the stub roll holder 130, a new roll 102 can be placed on top of the two spindle arms 116, which results in the new roll 102 riding on the unwound portion of the roll 102 in the stub roll holder 130 at the spindle arm 116*a*. The counterclockwise unwinding direction of the roll 102 in the stub roll holder 130 at the spindle arm 116*a* causes the new roll 102 riding on top of the unwinding portion of the roll 102 in the stub roll holder 130 to rotate in a clockwise direction. This results in the new roll 102 not unwinding into the cutting drum 120 and roller 122 thereby preventing simultaneous feeding of both the new roll 102 and the roll 102 in the stub roll holder 130. When the roll 102 in the stub roll holder 130 is depleted a user actuation (e.g., via the paper feed device) can cause the spindle arm 116*a* to rotate clockwise to start feeding the new roll 102 to the cutting drum 120 and roller 122 for dispensing to a user.

Below is an example process for dispensing paper product.

In response to a user action, at least one of a first spindle arm and second spindle arm is driven. For example, one or both of the spindle arms 116, supporting a roll 102, in a dispenser 100 are rotated in response to a user action such as a pull on an exposed portion of the roll 102 (e.g., at the opening 125) or from a motor actuation.

The rolled paper product is unwound in response to driving the at least one of a first spindle arm and second spindle arm. For example, the clockwise rotation of the spindle arm 116*a* causes the roll 102 to unwind in a counterclockwise direction feeding an unwound portion of the roll 102 to the cutting drum 120.

The unwound rolled paper product is cut with a cutting drum. For example, the cutting drum 120 makes the cut. In some implementations the cutting drum 120 rotates more than once before cutting.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A paper product dispenser comprising:

a housing comprising a front, a back, two sides, and a product holding area defined by the front, back and two sides;

a first spindle arm in the product holding area and extending between the two sides, a second spindle arm in the product holding area, extending between the two sides and substantially parallel to the first spindle arm, wherein the first and second spindle arms are configured to hold a rolled paper product along a periphery of the rolled paper product and rotate to allow the rolled paper product to be unwound;

a stub roll holder below the first and second spindle arms, wherein the first and second spindle arms are separated by a first distance and when a diameter of the paper product roll is less than the first distance the paper product roll drops into the stub roll holder, wherein after the paper product drops into the stub roll holder paper from the paper product travels over the first spindle arm in a counterclockwise direction during dispensing such that a new roll placed on the first and second spindle arms rotates in a clockwise direction during dispensing of the stub roll;

a paper feed device configured to cause the first spindle arm to rotate in a clockwise direction in response to a user action, wherein the user action is a manual actuation of a dispensing process through force applied to an actuation device of the dispenser; and a cutting drum configured to cut unwound portions of the rolled paper product.

2. The paper product dispenser of claim 1, wherein the first and second spindle arms lie in a same horizontal plane.

3. The paper product dispenser of claim 1, wherein the rolled paper product are hand towels.

4. The paper product dispenser of claim 1, wherein the first distance is between 60 and 90 millimeters.

5. The paper product dispenser of claim 1 comprising a feeding roller proximate to the cutting drum, wherein the feeding roller rotates in an opposite direction with respect to the cutting drum.

6. A method for dispensing paper product comprising:

in response to a user action, driving at least one of a first spindle arm and second spindle arm, wherein the first and second spindle arms are in spaced relation to each other and are configured to hold a rolled paper product along a periphery of the rolled paper product;

rotating the rolled paper product in a clockwise direction, without dispensing the rolled paper product to a user, in response to driving the at least one of a first spindle arm and second spindle arm;

unwinding a stub roll in a stub roll holder in a counterclockwise direction for dispensing to the user; and cutting the unwound rolled paper product with a cutting drum, wherein the cutting drum rotates more than once before the cutting.

* * * * *